United States Patent [19]

Moll

[11] Patent Number: 4,947,920

[45] Date of Patent: Aug. 14, 1990

[54] QUADRAFOLDABLE VEHICULAR WINDSHIELD SUNSHADE

[76] Inventor: Horst Moll, 1106 Scott St., Boise, Id. 83705

[21] Appl. No.: 261,419

[22] Filed: Oct. 24, 1988

[51] Int. Cl.[5] ..... A47H 5/00

[52] U.S. Cl. ..... 160/84.1; 160/370.2; 296/97.8

[58] Field of Search ..... 160/370.2, 84.1, DIG. 2, 160/DIG. 3, DIG. 4; 296/95.1, 136, 97.1, 97.7, 97.8

[56] References Cited

U.S. PATENT DOCUMENTS

| | | | |
|---|---|---|---|
| 4,671,334 | 6/1987 | Yadegar et al. | 160/84.1 |
| 4,727,920 | 3/1988 | Siegler | 160/84.1 |
| 4,758,042 | 7/1988 | Liu | 296/97.8 X |

*Primary Examiner*—Blair M. Johnson

*Attorney, Agent, or Firm*—Frank J. Dykas; Craig M. Korfanta

[57] ABSTRACT

A quadrafoldable vehicular windshield sunshade 10 constructed from a pair of planar cardboard segments 11 and 12 each having only folds in the longitudinal direction. Panels 11 and 12 each have a longitudinal length equal to approximately one-half the total length of the vehicle windshield. The panels 11 and 12 are each individually quadrafolded into a compact storage state and can be joined at their two edges *22a* and *22b* along the longitudinally intermediate lateral centerline by an "H" clip 17, a "U" clip 18, interlocking and overlapping fingers or tabs *25a* and *25b,* or by simply overlapping two lengthened panels 26 and 27, and securing them behind the rearview mirror 2.

18 Claims, 4 Drawing Sheets

QUADRAFOLDABLE VEHICULAR WINDSHIELD SUNSHADE

BACKGROUND OF THE INVENTION

1. Technical Field

This invention generally relates to sunshades for vehicle windshields, and in particular it relates to a foldable vehicular windshield sunshade without accordion folds.

2. Background Art

Accordion folded vehicle windshield sunshades, generally made from corrugated cardboard, are quite commonly used to prevent sun damage to vehicle dashboards and reduce heating of the interior of a car by sun rays. The most popular version is simply a rectangular panel of cardboard having a longitudinal dimension approximately equal to the length of a windshield and a transverse dimension, or width, approximately equal to the width of the windshield. The rectangular panel is provided with transverse accordion folds by alternately and transversely creasing the interior and exterior surfaces of the rectangle. In use, the sunshade is unfolded and placed in the front windshield and held in place by the dashboard, rearview mirror, and/or the sun visors. The problem with the transverse accordion like folds is that the sunshade tends to separate from the windshield at the ends and/or the middle by sagging. This sagging and separation of the sunshade from the windshield allows sun rays to penetrate into the interior of the car which is very undesirable.

A similar vehicular sunshade is taught by YADEGAR, ET AL., U.S. Pat. No. 4,671,334 which teaches a foldable vehicular sunshade which is collapsible to a smaller state. This is accomplished by providing a longitudinal fold about which the transverse panels can be folded. Again, the sunshade tends to pull away from the windshield, allowing sun rays to penetrate to the interior of the car. An even more compact foldable windshield sunshade is taught by SIEGLER, U.S. Pat. No. 4,727,920 which teaches a sunshade having a plurality of both transverse and longitudinal folds which create a series of hinged planar parallelograms. The sunshade of Siegler can be folded into a very compact state but is even more prone to separating from the windshield and thereby allowing sun rays to penetrate to the interior of the car.

The problem with any vehicular sunshade having transverse folds is that it is difficult, if not impossible, to provide adequate support in the longitudinal direction to prevent the sunshade from pulling away from the windshield and allowing the sun rays to penetrate to the interior of the vehicle.

What is needed, is a foldable vehicular windshield sunshade which does not have transverse accordion like folds and is not prone to separation from the windshield.

It is therefore an object of the present invention to provide a foldable vehicular windshield sunshade having longitudinal folds which are designed to bias the sunshade against the windshield and prevent separation of the sunshade from the windshield.

DISCLOSURE OF INVENTION

This object is accomplished by a foldable vehicular windshield sunshade constructed from a pair of planar cardboard segments each having only folds in the longitudinal direction. Each panel has a longitudinal length equal to approximately one-half the total length of the vehicle windshield. The panels can each individually be quadrafolded into a compact storage state. When unfolded, the panels can be joined at their two edges along the longitudinally intermediate lateral centerline by an "H" clip, a "U" clip, interlocking and overlapping fingers or tabs, or by simply overlapping two lengthened panels and securing them behind the rearview mirror.

BEST MODE FOR CARRYING OUT INVENTION

Figure 1:
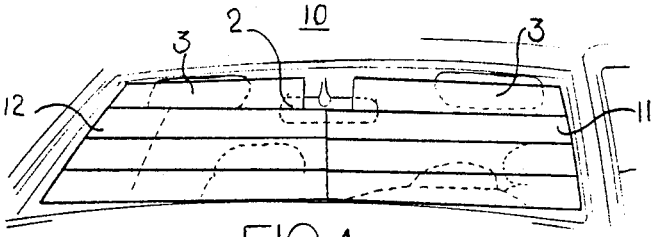
FIG. 1 is a plan view showing a quadrafoldable vehicular/windshield sunshade installed within the front windshield of a car.
Figure 2:
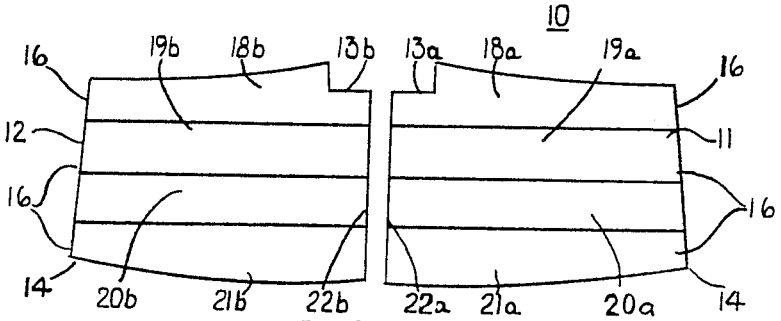
FIG. 2 is a plan view of a pair of panels which make up the quadrafoldable vehicular windshield sunshade.

FIG. 1 shows a quadrafoldable vehicular windshield sunshade 10 installed in the front windshield of vehicle 1. Quadrafoldable vehicular windshield sunshade 10, hereinafter referred to as sunshade 10, is composed of left panel 11, disposed on the driver's side, and right panel 12 held in side by side arrangement by rearview mirror 2 and visors 3. Referring also now to FIG. 2, left and right panels 11 and 12 are shown having the exterior surface 15, which is the sun facing surface, facing out. Panels 11 and 12 are constructed being mirror images of one another. Rearview mirror cutouts 13*a* and 13*b* are provided and sized to facilitate the installation of panels 11 and 12 behind rearview mirror 2. Panels 11 and 12 each have a longitudinal dimension approximately equal to one-half the total length of the windshield and a lateral or width dimension approximately equal to the width of the vehicle windshield. Longitudinal folds 17 divide each of the panels up into four segments, panel 11 being divided into top left segment 18*a*, left upper medial segment 19*a*, left lower medial segment 20*a*, and left bottom segment 21*a* and panel 12 likewise being divided into top right segment 18*b*, right upper medial segment 19*b*, right lower medial segment 20*b* and right bottom segment 21*b*. The panels are joined or placed adjacent to one another at left longitudinally intermediate lateral edge 22*a* and right longitudinal intermediate lateral edge 22*b*. The edges are so named because when in use, they generally fall coincident on the longitudinally intermediate lateral center line of the vehicle, which separates the right and left or passenger and driver's sides.

Figure 3A:
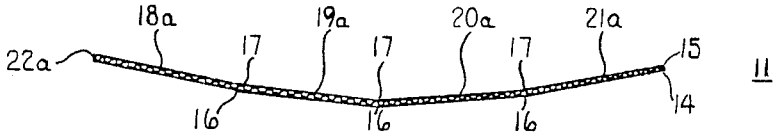
FIG. 3*a* is an edge view taken along the longitudinally intermediate lateral edge which shows the panel in an unfolded state.
Figure 3B:
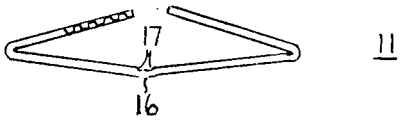
FIG. 3*b* is an edge view taken along the longitudinally intermediate lateral edge which shows the panel in a partially quadrafolded state.
Figure 3C:
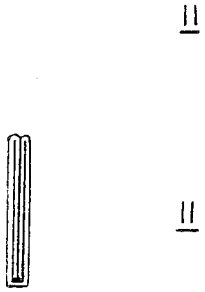
FIG. 3 *c* is an edge view taken along the longitudinally intermediate lateral edge which shows the panel in a quadrafolded state.

Referring now to FIG. 3*a*, left panel 11 is shown in an end view of left longitudinally intermediate lateral edge 22*a*. This view shows to advantage how panel 11 is designed to quadrafold. During manufacture, panel 11 is provided with longitudinal creases 17 on its interior surface 14 which produce folds 16. FIGS. 3*a*, 3*b*, and 3*c* together demonstrate how panel 11 is quadrafolded into its compact state which is shown in end view in FIG. 3*c*. FIG. 3*b* shows a plurality of creases 17 defining the fold 16 coincident on the longitudinal center axis of panel 11. The number of creases 17 per fold 16 are dependent upon the thickness of the material selected for construction, which is in this case a corrugated cardboard.

To accomplish the quadrafolding of panel 11, as is shown in FIGS. 3*a* through 3*c*, top left segment 18*a* is folded such that its interior surface !4 comes in contact with the interior surface of left upper medial segment 19*a*. Identically, left bottom segment 21*a* is folded such that its interior surface 14 comes in contact with interior surface 14 of left lower medial segment 20*a*. Panel 11 is then folded about the longitudinal fold 16 which lies on the longitudinal axis such that the exterior surface 15 of panels 21*a* and 18*a* come into contact with each other. Right panel 12 is quadrafolded in a similar manner.

Quadrafolding panels 11 and 12 provides a unique and unobvious advantage in that when the panels are unfolded and installed within the windshield of vehicle 1, longitudinal folds 16 bias the panels four segments against the windshield, preventing sunshade 10 from pulling away from the windshield and light from penetrating to the interior of vehicle 1 through the front windshield. Panels 11 and 12 are advantageously held in the windshield by mirror 2 and visors 3 and the dashboard of vehicle 1. Because the present invention does not use transverse folds, nor are longitudinal folds 16 accordion folds, sunshade 10 will not sag or pull away from the windshield.

Figure 4A:
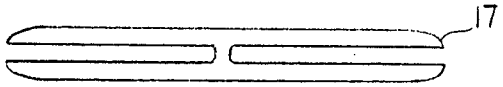
FIG. 4*a* is a plan view of an "H" clip.
Figure 4B:
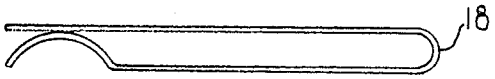
FIG. 4*b* is a plan view of a "U" clip.

Referring now to FIGS. 4*a* and 4*b*, "H" clip 17 and "U" clip 18 are shown. "H" clip 17 is provided to join panels 11 and 12 of FIGS. 1 and 2 together at their longitudinally intermediate lateral edges 22*a* and 22*b*. "U" clip 18 is provided to join panels 26 and 27, shown in FIGS. 5 and 6, together and the longitudinally intermediate centerline. "H" clip 17 and "U" clip 18 prevent panels 11 and 12, and 26 and 27, from separating and allowing light to penetrate therethrough.

Figure 5:
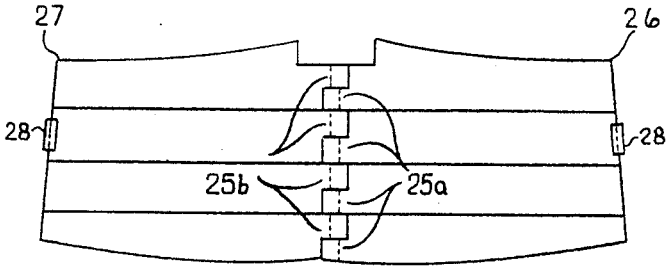
FIG. 5 is a plan view of a quadrafoldable vehicular windshield sunshade equipped with interlocking and overlapping tabs.
Figure 6:
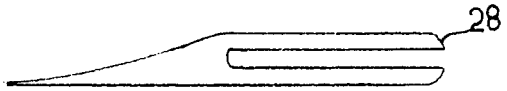
FIG. 6 is a side view of a sunshade wedge.

FIGS. 5 and 6 show an alternative embodiment wherein left and right panels 11 and 12 of FIGS. 1 and 2 are replaced by left and right panels 26 and 27 which are exaggerated in the longitudinal dimension to be greater than one-half the total longitudinal length of the vehicle windshield. Referring specifically to FIG. 5, a plurality of overlapping and interlocking tabs or fingers 25*a* and 25*b* are provided. Tabs 25*a* and 25*b* are alternatively overlapped and interconnected in connecting left and right panels 26 and 27. FIG. 6 shows left and right panels 26 and 27 simply overlapping on another. In this particular embodiment, left and right panels 26 and 27 are held in place by the vehicle visors, rearview mirror 2 via rearview mirror cut out 13 and sunshade wedges 28. FIG. 7 shows sunshade wedge 28 from an end view having a tapered end 29 for insertion between a windshield and the windshield molding. In this manner, sunshade wedge 28 can be attached to an outside edge of sunshade 10 with tapered edge 29 wedged between the molding and windshield to help retain sunshade 10 in the vehicle windshield.

While there is shown and described the present preferred embodiment of the invention, it is to be distinctly understood that this invention is not limited thereto but may be variously embodied to practice within the scope of the following claims.

I claim:

1. A foldable vehicular windshield sunshade which comprises:

a pair of planar cardboard panels each having a longitudinal length approximately equal to one half the length of the vehicle windshield and a width approximately equal to the width of the windshield, each of said panels having an exterior surface and interior surface where said exterior surface is defined as the sun facing surface, each of said panels further having three creases disposed parallel to a longitudinal center line, the convex side of each crease being located on said exterior surface and being equidistance from one another and the two edges which define the panels longitudinal length, thereby providing a quadrafoldable panel.

2. The sunshade of claim 1 wherein the perimeter of said panels is contoured to fit the perimeter of the windshield.

3. The sunshade of claim 2 wherein both said panels have a mirror cut out sized to facilitate installation of said panels behind a rearview mirror and for engagement of said panels with the rearview mirror for retaining said panels in the windshield.

4. The sunshade of claim 3 wherein said panels are of sufficient width to be held in place by a sun visor attached to the vehicle and the vehicle's dashboard.

5. The sunshade of claim 4 further comprising an "H" shaped clip for connecting said panels to form a single sunshade having a longitudinal dimension essentially equal to that of the length of the windshield.

6. The sunshade of claim 4 further comprising a "U" shaped clip for connecting said panels to form a single sunshade having a longitudinal dimension essentially equal to that of the length of the windshield.

7. The sunshade of claim 4 further comprising a plurality of tabs attached to each of said panels for connecting said panels to form a single sunshade having a longitudinal dimension essentially equal to the length of the windshield, said connection accomplished by alternately overlapping and interconnecting corresponding tabs on each of said panels.

8. The sunshade of claim 4 wherein said panels have exaggerated longitudinal dimensions for overlapping one another when installed in the windshield.

9. The sunshade of claim 1 wherein both said panels have a mirror cut out sized to facilitate installation of said panels around a rearview mirror and for engagement of said panels with the rearview mirror for retaining said panels in the windshield.

10. The sunshade of claim 9 wherein said panels are of sufficient width to be held in place by a sun visor attached to the vehicle.

11. The sunshade of claim 10 further comprising an "H" shaped clip for connecting said panels to form a single sunshade having a longitudinal dimension essentially equal to that of the windshield length.

12. The sunshade of claim 10 further comprising a "U" shaped clip for connecting said panels to form a single sunshade having a longitudinal dimension essentially equal to that of the windshield length.

13. The sunshade of claim 10 further comprising a plurality of tabs attached to each of said panels for connecting said panels to form a single sunshade having a longitudinal dimension essentially equal to that of the windshield, said connection accomplished by alternately overlapping and interconnecting corresponding tabs on each of said panels.

14. The sunshade of claim 10 wherein said panels have exaggerated longitudinal dimensions for overlapping one another when installed in the windshield.

15. The sunshade of claim 1 further comprising an "H" shaped clip for connecting said panels to form a single sunshade having a longitudinal dimension essentially equal to that of the windshield length.

16. The sunshade of claim 1 further comprising a "U" shaped clip for connecting said panels to form a single sunshade having a longitudinal dimension essentially equal to that of the windshield length.

17. The sunshade of claim 1 further comprising a plurality of tabs attached to each of said panels for connecting said panels to form a single sunshade having a longitudinal dimension essentially equal to that of the windshield, said connection accomplished by alternately overlapping and interconnecting corresponding tabs on each of said panels.

18. The sunshade of claim 1 wherein said panels have exaggerated longitudinal dimensions for overlapping one another when installed in the windshield.

* * * * *